US007758765B2

(12) United States Patent
Bauer et al.

(10) Patent No.: US 7,758,765 B2
(45) Date of Patent: Jul. 20, 2010

(54) COATING AGENT FOR SUN PROTECTION ARTICLES

(75) Inventors: Wolfgang Bauer, Graz (AT); Joachim Haussmann, Fernitz (AT)

(73) Assignee: Sattler AG, Graz (AT)

( * ) Notice: Subject to any disclaimer, the term of this patent is extended or adjusted under 35 U.S.C. 154(b) by 774 days.

(21) Appl. No.: 11/095,653

(22) Filed: Apr. 1, 2005

(65) Prior Publication Data

US 2005/0261408 A1 Nov. 24, 2005

(30) Foreign Application Priority Data

Apr. 1, 2004 (DE) ..... 10 2004 016 773

(51) Int. Cl.
*C09K 21/00* (2006.01)
*D06M 11/83* (2006.01)

(52) U.S. Cl. ..... 252/8.61; 252/8.84; 252/8.85; 252/8.86; 252/8.91; 252/608; 8/115.6; 428/365; 428/368

(58) Field of Classification Search ..... 252/608, 252/8.61, 8.84, 8.85, 8.91; 8/115.6, 637.1; 428/365, 368
See application file for complete search history.

(56) References Cited

U.S. PATENT DOCUMENTS

| | | | | | |
|---|---|---|---|---|---|
| 3,496,057 | A | * | 2/1970 | McCluer | 428/549 |
| 3,978,011 | A | * | 8/1976 | Molbert | 521/121 |
| 4,196,259 | A | * | 4/1980 | Augustin et al. | 428/492 |
| 4,510,282 | A | * | 4/1985 | Goll | 524/337 |
| 4,600,606 | A | * | 7/1986 | Mischutin | 427/389 |
| 4,670,503 | A | * | 6/1987 | Neumann et al. | 524/520 |
| 4,677,016 | A | * | 6/1987 | Ferziger et al. | 428/212 |
| 5,645,926 | A | * | 7/1997 | Horrocks et al. | 442/234 |
| 5,985,773 | A | * | 11/1999 | Lee | 442/89 |

FOREIGN PATENT DOCUMENTS

| | | | |
|---|---|---|---|
| DE | 80 11 539 | | 9/1980 |
| DE | 3327016 | A1 | 2/1985 |
| DE | 85 06 847 | | 8/1986 |
| DE | 197 08 160 | A1 | 9/1998 |
| DE | 198 49 321 | A1 | 4/2000 |
| DE | 198 49 330 | A1 | 4/2000 |
| DE | 199 45 848 | A1 | 4/2001 |
| EP | 0 861 814 | A2 | 9/1998 |
| JP | 60-203208 | A | 10/1985 |
| JP | 63-246112 | A | 10/1988 |
| JP | 63246112 | * | 10/1998 |
| WO | WO 97/32930 | | 9/1997 |

OTHER PUBLICATIONS

European Search Report for European Application No. EP 05 00 6704, European Patent Office, Netherlands, mailed on Jul. 14, 2005.
STNEasy/CAplus database, Accession No. 1985:472548, English language abstract for DE 3327016 A1, document AO1, Feb. 14, 1985.
Derwent WPI database, Accession No. 1985-293797, English language abstract for JP 60-203208 A, document AP1, Mar. 27, 1984.
Derwent WPI database, Accession No. 1988-333761, English language abstract for JP 63-246112 A, document AL2, Oct. 13, 1988.
STNEasy/CAplus database, Accession No. 1998:603156, English language abstract for EP 0 861 814 A2, document AM2, Sep. 2, 1998.
Espacenet database, English language abstract for DE 198 49 330 A1, document AN2, Apr. 27, 2000.
STNEasy/CAplus Database, Accession No. 1998:603156, English language abstract for document AL1, DE 197 08 160 A1, Sep. 3, 1998.
STNEasy/CAplus Database, Accession No. 2000:275376, English language abstract for document AM1, DE 198 49 321 A1, Apr. 27, 2004.
STNEasy/CAplus Database, Accession No. 2001:247424, English language abstract for document AN1, DE 199 45 848 A1, Apr. 5, 2001.

* cited by examiner

*Primary Examiner*—Lorna M Douyon
*Assistant Examiner*—Amina Khan
(74) *Attorney, Agent, or Firm*—Sterne, Kessler, Goldstein & Fox P.L.L.C.

(57) ABSTRACT

Described is a pasty coating agent for textile sun protection articles which comprises finely divided polymeric particles, flame retardants, metal pigments and water with or without further additives. The paste serves to coat sun protection articles such as awnings, roller blinds, tents, shade-providing systems such as sunshades and the like. The sun protection articles thus endowed possess high reflectivity, excellent colour effects and low flammability.

11 Claims, No Drawings

COATING AGENT FOR SUN PROTECTION ARTICLES

The present application claims priority to German Patent Application No. 10 2004 016 773.7-43, filed Jan. 4, 2004, the disclosure of which is incorporated by reference in its entirety hereto.

The invention relates to a coating agent in the form of a paste for sun protection articles such as awnings, shade-providing systems such as for example sunshades, tent fabrics, roof-covering fabrics for example for yachts and the like, to a process for producing such pastes and to sun protection articles endowed with such pastes.

Coating agents of various kinds are well known. Their compositions differ according to the intended use and according to the substrate to which they are to be applied. In addition, the composition of a coating agent also depends on the properties the coating agent is to confer on the substrate in particular.

For instance, DE 199 45 848 A1 describes a coating agent for elastomers which is used as an aqueous polyurethane varnish dispersion and which serves to coat elastomers with a surface which has a very low coefficient of friction. Elastomer parts thus coated are useful for sealing off window shafts, for mobile parts of glass and/or as sealing profiles in vehicle construction and preferably in automotive construction. However, the coating agent described therein is in no way suitable for use as a coating agent for textile sun protection articles.

It is known to coat woven fabrics which are to be made into sun protection articles such as roller blinds for example with plastics and especially with polyvinyl chloride. However, the use of polyvinyl chloride is not generally recognized as safe for the environment (dioxin release in the event of a fire or else in the course of normal combustion).

Attempts have already been made to counteract these dangers by coating the textile support with two different layers, one of thermoset polymer and one of thermoplastic polymer, and to add a halogen-free flame retardant to these layers.

It is further known to add a wide variety of pigments to coating agents as described in DE 198 49 321 A1.

Finally, DE 197 08 160 A1 describes an unburnable waterproof awning material which consists of a woven glass fibre fabric which has been vapour deposition coated with aluminium and has a low-flammable coating of acrylic.

However, the sun protection articles and coating agents described above have a whole series of disadvantages. They variously fail to meet current requirements of a sun protection article. Moreover, the products are complicated to make.

There is thus still a need for improved coating agents for sun protection articles which are simple to make and process and which lead to sun protection articles having a multiplicity of desirable properties.

The invention therefore has for its object to provide a coating agent which is PVC-free, which is simple to make and easy to apply to sun protection articles and which leads to sun protection articles which are notable for flame resistance, good appearance and high reflectivity and which can be used both indoors and outdoors.

This object is achieved by a pasty PVC-free coating agent for textile sheetlike sun protection articles which comprises one or more polymer dispersions, flame retardants and metal pigments with or without further additives.

The paste preferably comprises a) 40-80 parts of polymer dispersion, b) 20-40 parts of flame retardant, c) 1-20 parts of metal pigments d) if desired 1-50 parts of further additives.

Useful polymer dispersions include customary commercial especially aqueous polymer dispersions. The polymers are generally present in these dispersions in a finely divided state whose particle size can typically vary within wide limits.

Useful polymers are particularly acrylates, acetates or polyurethanes, and mixture of polymers are also advantageous.

Antimony trioxide is a particularly useful flame retardant, but phosphorus compounds and especially phosphorus compounds based on phosphonic esters are further advantageous as flame retardants.

Especially aluminium is suitable for use as metal pigment.

The coating agent can if desired comprise additives such as emulsifiers, thickeners, wetters, hydrophobicizers, bonders, further pigments such as lustre pigments, sparkle pigments or dye pigments.

The invention further provides a process for producing a coating agent which is characterized in that a polymer dispersion is provided as an initial charge and has stirred into it in succession any non-metal pigments and/or emulsifiers, then flame retardants and subsequently the metal pigment.

The invention further provides a textile sheetlike sun protection article which was coated with one of the pasty coating agents described above and was dried after coating.

This sun protection article preferably further comprises a protective film.

Polymers useful in the invention are in particular acrylates, polyurethanes, especially the group of PU elastomers and acetate polymers.

Useful acrylate polymers in the invention are in particular polymers of esters of acrylic acid or of methacrylic acid and copolymers of these esters, which may additionally comprise styrene or butadiene as further comonomer component, and also N-methylolacrylamide.

Useful acetate polymers in the invention include in particular vinyl acetate polymers or copolymers, for example with vinyl chloride or acrylates. Polyvinyl alcohol and polyvinyl methyl ether are likewise to be identified in this connection.

Also suitable are inter alia polymers such as polyamides, polyamines, polyepoxides and so on.

The coating agent may comprise a single polymer, but mixtures of polymers and especially mixture of acrylate and polyurethanes are also useful.

The polymers are present in the coating agent in a finely divided state. They are included in the coating agent in the form of aqueous dispersions. The dispersions comprise sufficient water for homogeneous dispersion of the other additives namely the flame retardants and the metal pigment and also if appropriate further additives so that a readily spreadable paste is formed.

Useful flame retardants in the invention include customary flame retardants, especially flame retardants based on antimony trioxide and also phosphorus compounds, especially phosphonic esters.

Combinations are very suitable of two or more flame retardants such as for example antimony trioxide and also a halogen donor for example (hydro)fluorocarbons, bromine compounds.

Aluminium pigments are particularly useful as metal pigment. But instead of aluminium it is also possible to use other metal pigments, for example copper.

The coating agent is PVC free. As well as the three main constituents namely polymer particles, flame retardants and metal pigments and also water due to the polymer dispersion, the pastes may additionally comprise further additives, for example in order that specific colouring effects may be achieved. These include pigments such as for example iron oxide, azo colourants, carbon black, phthalocyanines and the like.

It is also possible to add further additives in order that beneficial performance characteristics may be obtained, such as improved spreadability, improved bonding and so on. Additives to be identified here include emulsifiers such as aryl polyglycol ethers, thickeners such as for example polymers based on acrylic acid or acrylic acid and acrylamide. Particularly suitable pigments further include pearl lustre pigments or else sparkle pigments especially based on PES. Useful bonders include in particular melamine-formaldehyde resins. The addition of such bonders improves the bonding between pigment and the other constituents of the paste.

Useful sun protection articles for coating with the paste according to the invention are in particular wovens, awning fabrics, roller blinds, shade-providing systems such as sunshades, tent fabrics, canopies especially canopies for covering comparatively small boats such as canoes, yachts and the like.

The reflectivity and also the low flammability of the end product can be controlled via the paste composition and also the amount of paste applied. It is generally sufficient to coat the substrate with an amount of 5 to 150 g/m$^2$ of paste.

The coating agents according to the invention can be applied via all common application processes such as padding processes or other coating processes, such as minimal add-on systems and also printing processes (rotary and flat screen printing processes).

Application can be effected onesidedly or bothsidedly, uniformly or also if appropriate, to achieve a defined optical transmission as a function of a freely choosable basis weight, partially.

To obtain a particular degree of lustre, it is possible to use metal pigments of differing particle size. The substrate, i.e. the textile sheetlike material which is coated with the paste, can be a textile fabric such as wovens or else formed-loop knits which consists essentially of synthetic material such as polyester especially polyethylene terephthalate, polyacrylonitrile, polypropylene and polyethylene, in short of materials from which the customary synthetic fibres are made. However, it is also possible to use glass fibres if desired in admixture with synthetic fibres, and also cellulosic fibre materials.

It is advantageous when the coated sun protection article is provided with an additional protective film after drying. An additional protective film makes it possible to improve the soil resistance and also reduce the wettability with water, for example rainwater. The invention will now be more particularly described with reference to an illustrative embodiment featuring two versions of a paste:

EXAMPLE

The substrate to be coated utilizes monofil threads of about 320 dtex and PET staple fibres, for example Trevira CS, of about 650 dtex (167 dtex×3) in a thread ratio of 2 monofil threads to 1 staple fibre in the warp direction and a modified acrylonitrile such as for example modacrylic (MAC) of about 30 tex×2 or else 60 tex singles yarn in the weft direction, the substrate composition having a basis weight of about 250 g/m$^2$.

To achieve optimal bonding for the paste to be subsequently applied, a 3-thread reed repeat should be employed to ensure that the staple fiber thread always ends up in the middle of the two monofil threads in the woven construction.

The substrate is pretreated and finished by an alkaline soda wash with nonionic surfactant plus complexing agent and an aftertreatment with sequestrant. This is followed by drying over a 7 zone stenter at a circulating air average temperature of 130° C., a speed of about 14 m/min and a residual moisture content of about 35%; the coating is applied via a minimal add-on system customary in the textile arts, and drying and curing is effected over a 7 zone stenter at an average ambient air temperature of 155° C. and a speed of about 10 m/min.

The two paste recipes used according to the invention have the following compositions, paste example 1 aiming for an end product having optimized, i.e. maximum, reflectivity whereas paste example 2 aims for a combination effect, i.e. a compromise between reflectivity and colour effects:

Paste Example 1

| Chemical (components) | Parts |
|---|---|
| Acrylate binder dispersion (polymer dispersion) | 600 |
| Flame retardant (based on antimony trioxide + organic bromine compounds) | 270 |
| Emulsifier (aryl polyglycol ether, APEO-free) | 4 |
| Melamine resin (melamine-formaldehyde resin) | 20 |
| Thickener (polymer based on acrylic acid) | 1 |
| Lustre pearl pigments | 20 |
| Aluminium pigments | 75 |
| Sum total: | 1000 |

Paste Example 2

| Chemical (components) | Parts |
|---|---|
| Acrylate binder dispersion (polymer dispersion) | 400 |
| Polyurethane binder dispersion (polymer dispersion) | 140 |
| Flame retardant (based on ammonium polyphosphate) | 270 |
| Emulsifier (aryl polyglycol ether, APEO-free) | 5 |
| Melamine resin (melamine-formaldehyde resin) | 20 |
| Sparkle pigments | 10 |
| Dye pigments | 10 |
| Aluminium pigments | 75 |
| Sum total: | 1000 |

The production of the invention's coating paste variations itself traverses the following process steps, for which the order is important:

Polymeric binder or binders, lustre pearl pigments (or sparkle pigments as the case may be), emulsifier and flame retardant are mixed in this order and in the number of parts identified in each case, then stirred at 80 Hz (setting of the customary reversing motor) for a stirring time of 5 minutes and subsequently, after admixture of the aluminium pigments, again stirred at 80 Hz for 10 minutes. Immediately prior to the coating step, the synthetic resin component is admixed, which is followed by stirring at 80 Hz for 15 minutes. The colour is then checked.

The coating process is followed by an aftertreatment in the form of the application of a protective film over the coated fabric. This is accomplished by means of a pad mangle, curing of the film over a 7 zone stenter at a circulating air average temperature of 155° C. and a speed of about 14 m/min. The hand-modifying recipe used is (per litre of water):

4 g of phosphoric ester wetting agent,
20 g of fluorocarbon resin,
40 g of fat-modified synthetic resin (melamine derivative),
30 g of synthetic resin (melamine-formaldehyde resin),
12 g of magnesium chloride (catalyst),
2 g of urea,
1 g of citric acid.

This illustrative embodiment ensures that the following performance characteristics of the ready-treated end product are particularly prominent and are controllable in their intensity via the paste components:

- highest possible reflectance of incident sunlight coupled with good transmission of light into room interior
- the high reflectance and low absorption of the product result in small g values (energy transmission values), whereby a room interior will warm up only minimally but will nevertheless appear well lit from the outside
- the product is by virtue of the staple threads in the substrate and the PVC-free paste of very natural appearance compared with other products currently on the market
- the product is PVC free
- as the product gets warm, it does not undergo any change in the form of tackiness or odour evolution as is the case for example with PVC products at elevated temperature Furthermore the fabric construction and the aftersealing after paste application provide the following additional improved properties:

- good dimensional stability
- improved rollability
- good hand for making up
- good runnability on rails
- good oil and soil repellency
- no in-storage tackiness on heating
- good durability of paste
- no harmful vapours develop on burning as for example in the case of PVC-coated products

The invention claimed is:

1. A PVC-free, pasty coating agent for textile sheetlike sun protection articles, comprising:

(a) 40-80 parts of an aqueous polymer dispersion formed of finely divided polymer and water, wherein the polymer is an acrylate, acetate, polyurethane, or a mixture thereof;

(b) 20-40 parts of one or more flame retardants;

(c) 1-20 parts of one or more metal pigments; and (d) 1-50 parts of one or more further additives selected from the group consisting of emulsifiers, thickeners, bonders, and pigments, wherein the pigments include at least one of lustre pigments, sparkle pigments, and dye pigments, wherein the sum of all components in the coating agent is 62-190 total parts, and wherein the aqueous polymer dispersion has sufficient water to provide a homogeneous aqueous dispersion of components (a), (b), (c) and (d) in a PVC-free paste.

2. Coating agent according to claim 1, characterized in that it comprises a mixture of polymers.

3. Coating agent according to claim 1, characterized in that it comprises antimony trioxide as a flame retardant.

4. Coating agent according to claim 1, characterized in that it comprises phosphorus compounds as flame retardants.

5. Coating agent according to claim 1, characterized in that it comprises aluminum as a metal pigment.

6. Coating agent according to claim 1, wherein the finely divided polymer in the polymer dispersion are a mixture of acrylate and polyurethane.

7. Coating agent according to claim 1, wherein the amount of flame retardant in the coating agent is 27% by weight.

8. Textile sheetlike sun protection article, characterized in that it has been coated with a pasty coating agent according to claim 1.

9. Sun protection article according to claim 8, characterized in that the sun protection article further comprises a protective film.

10. A PVC-free, pasty coating agent for textile sheetlike sun protection articles, consisting essentially of:

(a) 40-80 parts of an aqueous polymer dispersion formed of finely divided polymer and water, wherein the polymer is an acrylate, acetate, polyurethane, or a mixture thereof;

(b) 20-40 parts of one or more flame retardants;

(c) 1-20 parts of one or more metal pigments; and optionally (d) 1-50 parts of one or more further additives, wherein the aqueous polymer dispersion has sufficient water to provide a homogeneous aqueous dispersion of components (a), (b), and (c), and optionally (d) in a PVC-free paste.

11. Coating agent according to claim 10, wherein the one or more further additives are selected from the group consisting of emulsifiers, thickeners, bonders, and pigments, wherein the pigments include at least one of lustre pigments, sparkle pigments, and dye pigments.

* * * * *